US007378206B2

(12) United States Patent
Lee et al.

(10) Patent No.: US 7,378,206 B2
(45) Date of Patent: May 27, 2008

(54) NON-MAGNETIC MONOCOMPONENT POSITIVE TONER COMPOSITION HAVING SUPERIOR TRANSFER EFFICIENCY

(75) Inventors: Won-Sup Lee, Daejeon (KR); Chang-Soon Lee, Daejeon (KR); Hyea-Eun Han, Daejeon (KR); Kwang-Ho Song, Daejeon (KR)

(73) Assignee: LG Chem, Ltd. (KR)

( * ) Notice: Subject to any disclaimer, the term of this patent is extended or adjusted under 35 U.S.C. 154(b) by 352 days.

(21) Appl. No.: 10/505,914

(22) PCT Filed: Jan. 12, 2004

(86) PCT No.: PCT/KR2004/000038

§ 371 (c)(1),
(2), (4) Date: Jul. 19, 2005

(87) PCT Pub. No.: WO2004/079456

PCT Pub. Date: Sep. 16, 2004

(65) Prior Publication Data

US 2006/0105260 A1 May 18, 2006

(30) Foreign Application Priority Data

Jan. 13, 2003 (KR) ..... 10-2003-0002057

(51) Int. Cl.
*G03G 9/087* (2006.01)

(52) U.S. Cl. ..... 430/108.11; 430/108.7; 430/109.3

(58) Field of Classification Search ..... 430/108.11, 430/108.7, 109.3, 108.1
See application file for complete search history.

(56) References Cited

U.S. PATENT DOCUMENTS

| | | | | |
|---|---|---|---|---|
| 2,297,691 | A | 10/1942 | Carlson | |
| 2,618,552 | A | 11/1952 | Wise | |
| 2,874,063 | A | 2/1959 | Greig | |
| 3,909,258 | A | 9/1975 | Kotz | |
| 5,445,910 | A * | 8/1995 | Ishikawa et al. | 430/108.11 |
| 5,863,692 | A | 1/1999 | Nakamura et al. | |
| 6,074,795 | A * | 6/2000 | Watanabe et al. | 430/108.4 |
| 6,187,489 | B1 * | 2/2001 | Oishi et al. | 430/45.1 |
| 6,287,739 | B1 * | 9/2001 | Kawakami et al. | 430/108.7 |
| 6,566,025 | B1 * | 5/2003 | McStravick et al. | 430/108.11 |

FOREIGN PATENT DOCUMENTS

| | | | |
|---|---|---|---|
| EP | 978766 | A1 * | 2/2000 |
| JP | 419475 | | 5/1966 |
| JP | 4223910 | | 11/1967 |
| JP | 4324748 | | 10/1968 |
| JP | 2000206732 | | 7/2000 |
| JP | 2000275905 | A * | 10/2000 |
| WO | 9829783 | | 7/1998 |
| WO | 0184248 | | 11/2001 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Written Opinion dated Apr. 13, 2004 for Application No. PCT/KR2004/000038.

International Search Report dated Apr. 13, 2004 for Application No. PCT/KR2004/000038 (All references cited in the Search Report are listed above).

* cited by examiner

*Primary Examiner*—Christopher RoDee
(74) *Attorney, Agent, or Firm*—Cantor Colburn LLP

(57) ABSTRACT

The present invention relates to a non-magnetic monocomponent toner composition, which comprises a) a non-magnetic toner particle comprising a binding resin comprising a binder resin and a copolymer of a cyclic olefin and an acyclic olefin polymerized in the presence of a metallocene catalyst and a cocatalyst, a colorant, and a charge-control agent; b) fine powder of an organic compound containing fluorine that is added to the surface of the non-magnetic toner particle; and c) hydrophobic silica having a specific surface area of 100 to 240 $m^2/g$. The toner composition of the present invention has superior transfer efficiency and charging properties and thus can obtain a stable image, does not show deteriorated image density, and does not generate background contamination of non-image areas and off-set due to deterioration of fixing properties, even if copying or printing is conducted therewith for a long time use.

15 Claims, No Drawings

NON-MAGNETIC MONOCOMPONENT POSITIVE TONER COMPOSITION HAVING SUPERIOR TRANSFER EFFICIENCY

BACKGROUND OF THE INVENTION (a) Field of the Invention

The present invention relates to a non-magnetic mono-component toner composition, and more particularly to a non-magnetic mono-component toner composition which has superior transfer efficiency and charging properties, and thus can obtain stable images, does not show deteriorated image density, and does not generate background contamination of non-image areas and off-set due to deterioration of fixing properties, even if copying or printing is conducted therewith for a long time use.

(b) Description of the Related Art

Generally, according to conventional electrophotography methods, an electrostatic latent image forms on the surface of a photosensitive member using photoconductive materials, the latent image is developed using a toner, and the toner image is transferred to a recording medium such as paper to obtain a copy fixed by heat or pressure, as disclosed in U.S. Pat. No. 2,297,691, Japanese Laid-Open Patent Publication No. 42-23910, Japanese Laid-Open Patent Publication No. 43-24748, etc.

Additionally, various development methods for developing electrostatic latent images using a toner are also known. For example, U.S. Pat. No. 2,874,063 discloses a magnetic brush development method, U.S. Pat. No. 2,618,552 discloses a cascade development method, Japanese Laid-Open Patent Publication No. 41-9475 discloses a development method using a mono-component insulating toner, and U.S. Pat. No. 3,909,258 discloses a development method using a mono-component conductive toner, and among the above, the dual-component magnetic brush development method and the mono-component insulating toner development method are predominantly used.

However, the electrophotography development method wherein a photosensitive member is uniformly charged, an electrostatic latent image forms by light exposure or laser beam, and a toner is supplied to the electrostatic latent image to form a visual image, has a problem in that ozone is generated from a charging apparatus. Particularly, taking environmental aspects into consideration, an organic photosensitive member that is most widely used generally has a negative charge property, and thus prevention of ozone generation during the charging process is difficult.

In order to reduce ozone, a contact charging method has been suggested wherein a conductive member such as a conductive brush, a conductive elastic member roller, etc. is contacted with a photosensitive member and voltage is applied. However, such contact charging method involves a problem in terms of contamination of the conductive members. Since the conductive member is in contact with a photosensitive member, a toner, external additive for a toner, etc. that are attached to the photosensitive member are in turn attached to the conductive member to generate an irregular charging on the surface of the photosensitive member.

In order to solve the above problems, an organic photosensitive member having a positive charge property has been developed. If a positive charge is used, even if a corona charging method is used, ozone generation can be reduced to approximately 1/10 compared to a negative charge.

Meanwhile, a non-magnetic mono-component toner used in the positive charging development method requires high transfer efficiency and high chargeability compared to the negative charging development method. For this, an external additive is attached to a toner particle. However, in the case a toner to which one kind of external additive is attached is used for the non-magnetic mono-component development method, since there is friction between the toner particle and a doctor blade or a developing roller, the external additive attached to the toner particle surface is embedded in the toner particle, and thus the flowability-increasing effect of the external additive deteriorates, and transfer efficiency and charging properties are not sufficient, thereby deteriorating the image after printing and the long term stability of the image.

In order to solve the above problems, a method has been suggested wherein a toner with a positive charge property is developed onto a surface of a positively charged organic photosensitive member, the toner that is developed with high transfer efficiency is transferred to a reporting medium such as paper, and fine powder of an organic compound containing fluorine is used in addition to a single external additive of hydrophobic silica in order to reduce image background contamination. However, this method involves a problem in that off-set is generated in the fixing process.

Accordingly, there are increasing needs for a non-magnetic mono-component toner that has superior transfer efficiency and charging properties, and does not generate background contamination of non-image areas and off-set due to deterioration of fixing properties.

SUMMARY OF THE INVENTION

The present invention relates to a non-magnetic mono-component toner composition that has superior transfer efficiency and charging properties, and thus can obtain a stable image, does not show deterioration of image density, and does not generate background contamination of non-image areas and off-set due to deterioration of fixing properties, even if copying or printing is conducted therewith for a long time use.

DETAILED DESCRIPTION OF THE PREFERRED EMBODIMENTS

In order to solve the problems of the prior art, it is an object of the present invention to provide a non-magnetic mono-component toner composition that has superior transfer efficiency and charging properties, and thus can obtain a stable image, does not show deterioration of image density, and does not generate background contamination of non-image areas and off-set due to deterioration of fixing properties, even if copying or printing is conducted therewith for a long time use.

In order to achieve the above object, the present invention provides a non-magnetic mono-component toner composition which comprises:

a) 100 parts by weight of a non-magnetic toner particle comprising i) 100 parts by weight of a binding resin comprising 10 to 90 parts by weight of a copolymer of a cyclic olefin and an acyclic olefin polymerized in the presence of a metallocene catalyst and a cocatalyst, and 100 parts by weight of a binder resin, ii) 1 to 20 parts by weight of a colorant, and iii) 0.2 to 6 parts by weight of a charge-control agent;

b) 0.05 to 2.0 parts by weight of fine powder of an organic compound containing fluorine that is added to the surface of the non-magnetic toner particle; and c) 0.5 to 2.0 parts by weight of hydrophobic silica having a specific surface area of 100 to 240 $m^2/g$.

The present invention will be explained in more detail.

The present inventors, while studying a non-magnetic mono-component toner that has superior transfer efficiency and charging properties, and does not generate background contamination of non-image areas and off-set due to deterioration of fixing properties, prepared a non-magnetic mono-component toner by externally adding hydrophobic silica having a specific surface area of 100 to 240 $m^2/g$ and fine powder of an organic compound containing fluorine to a non-magnetic toner particle surface which comprises a binding resin comprising a copolymer of a cyclic olefin and an acyclic olefin polymerized in the presence of a metallocene catalyst and a cocatalyst, and a binder resin, a colorant, and a charge-control agent. As a result, it was identified that the toner has superior transfer efficiency and charging properties and thus can obtain a stable image, does not show deterioration of image density, and does not generate background contamination of non-image areas and off-set due to deterioration of fixing properties, even if copying or printing is conducted therewith for a long time use, and completed the preset invention.

The non-magnetic mono-component toner composition of the present invention is characterized in that hydrophobic silica having a specific surface area of 100 to 240 $m^2/g$ and a fine powder of an organic compound containing fluorine are externally added to a non-magnetic toner particle surface which comprises a binding resin comprising a binder resin and a copolymer of a cyclic olefin and an acyclic olefin polymerized in the presence of a metallocene catalyst and a cocatalyst, a colorant, and a charge-control agent.

The non-magnetic toner particle comprises 100 parts by weight of a binding resin comprising 100 parts by weight of a binder resin and 10 to 90 parts by weight of a copolymer of a cyclic olefin and an acyclic olefin polymerized in the presence of a metallocene catalyst and a cocatalyst, 1 to 20 parts by weight of a colorant, and 0.2 to 6 parts by weight of a charge control agent, on the basis of 100 parts by weight of the binding resin, and it may further comprise a release agent such as polypropylene or polyethylene.

The copolymer of a cyclic olefin and an acyclic olefin is preferably contained in 100 parts by weight of the binder resin in an amount of 10 to 90 parts by weight. If the content is less than 10 parts by weight, it cannot solve off-set due to deterioration of fixing properties caused by an externally added fine powder of an organic compound containing fluorine, and if the content exceeds 90 parts by weight, compatibility with a binder resin decreases and thus dispersion between toner ingredients is not uniform to deteriorate charging properties, and cost of raw material increases as the used amount increases and thus it is not economical.

The copolymer of a cyclic olefin and an acyclic olefin is prepared by copolymerizing a cyclic olefin monomer with an acyclic monomer without opening a ring of the cyclic olefin monomer using a metallocene catalyst and a cocatalyst. The copolymer preferably comprises at least 14 mol % of norbornene-type monomers, and more preferably at least 50 mol % of norbornene-type monomers.

As the cyclic monomer, a norbornene-type monomer represented by one of the following Chemical Formulae 1 to 6, or an ethylene-based cyclic monomer represented by the following Chemical Formula 7 can be used:

[Chemical Formula 1]

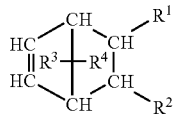

[Chemical Formula 2]

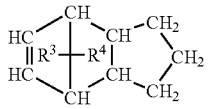

[Chemical Formula 3]

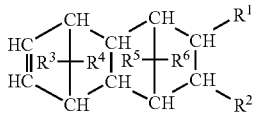

[Chemical Formula 4]

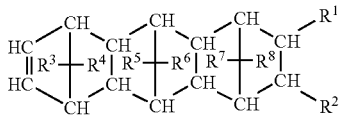

[Chemical Formula 5]

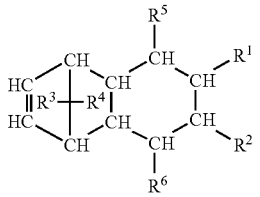

[Chemical Formula 6]

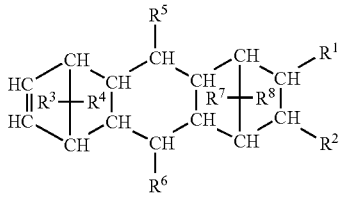

In the above Chemical Formulae 1 to 6, $R^1$ to $R^8$ are independently hydrogen, C6-C16 aryls, or C1-C8 alkyls.

[Chemical Formula 7]

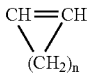

In the above Chemical Formula 7, n is an integer of 2 to 10.

The monocyclic olefin compound represented by the above Chemical Formula 7 can be substituted with an aryl or alkyl radical. As the monocyclic olefin compound, cyclopentene, cycloindene, or cyclooctene can be used, and preferably cyclopentene is used.

The cyclic olefin monomer is preferably contained in an amount of 0.01 to 99.9 wt %. If the content is less than 0.01 wt %, the resulting polymer may become polyethylene, and if the content exceeds 99.9 wt %, the resulting polymer may become polynorbornene.

As the acyclic olefin monomer, a compound represented by the following Chemical Formula 8 is preferably used.

[Chemical Formula 8]

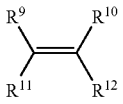

In the above Chemical Formula 8, $R^9$ to $R^{12}$ are independently hydrogen, or C1-C8 alkyls.

The acyclic olefin monomer is preferably contained in an amount of 0.01 to 99.9 wt %. If the content is less than 0.01 wt %, the resulting copolymer may become polyethylene, and if the content exceeds 99.9 wt %, the copolymer may become polynorbornene.

The copolymer of the cyclic olefin and acyclic olefin is preferably a copolymer of a polycyclic olefin monomer represented by the above Chemical Formula 1 or 2 and an acyclic olefin monomer represented by the above Chemical Formula 8. And, polycyclic olefin derivatives comprising norbornene and tetracyclododecene and substituted with C1-C6 alkyl can also be used, which can be copolymerized with ethylene.

The copolymer can be polymerized by a common method, and it is preferably polymerized at 20~120° C. under a pressure of 1-60 bar.

The polymerization of the copolymer is conducted in solution, and it is preferable to polymerize in the presence of a metallocene catalyst and a cocatalyst in order to facilitate polymerization of the desired copolymer. The cocatalyst is preferably contained in an amount of 1 wt % to saturation concentration, and the metallocene catalyst is preferably contained in an amount of $10^{-4}$ to $10^{-2}$ moles per 1 mole of the cocatalyst.

The metallocene catalyst can perform only in the presence of a cocatalyst. If a cocatalyst is not used, polymerization of the copolymer of a cyclic olefin and an acyclic olefin progresses very slowly, and even when 48 hours are passed, the copolymer may not be prepared. Thus, the polymerization should be conducted together with a cocatalyst.

It is preferable to previously mix the metallocene catalyst with a cocatalyst to activate at a temperature of 15 to 70° C. for 15 to 60 minutes, and introduce the mixture into a reactor.

The metallocene catalyst is preferably represented by the following Chemical Formula 9.

[Chemical Formula 9]

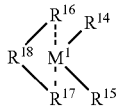

In the above Chemical Formula 9, $M^1$ is titanium (Ti), zirconium (Zr), hafnium (Hf), vanadium (V), niobium (Nb), or tantalum (Ta);

$R^{14}$ and $R^{15}$ are independently hydrogen, halogens, C1-C10 alkyls, C1-C10 alkoxys, C6-C10 aryls, C6-C10 aryloxys, C2-C10 alkenyls, C7-C40 arylalkyls, C7-C40 alkylaryls, or C8-C40 arylalkenyls; and $R^{16}$ and $R^{17}$ are independently mononuclear or polynuclear hydrocarbon radicals, which can form a ring together with the center atom M1.

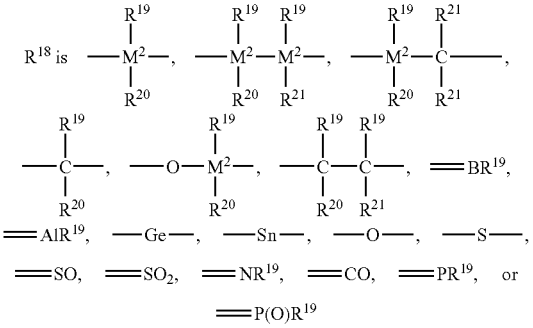

wherein to $R^{19}$ to $R^{21}$ are independently hydrogen, halogens, C1-C10 alkyls, C1-C10 fluoroalkyls, C1-C10 fluoroaryls, C6-C10 aryls, C1 -C10alkoxys, C6-C10 aryloxys, C2-C10 alkenyls, C7-C40 arylalkyls, or C8-C40 arylalkenyls; $R^{19}$ to $R^{21}$ may be independently connected to neighboring carbon atoms to form a ring; and $M^2$ is silicon (Si), germanium (Ge), or tin (Sn).

The metallocene catalyst is selected from the group consisting of rac-ethylene-bis-(1-indenyl)-zirconium dichloride, isopropylene-(9-fluorenyl)-cyclopentadienyl-zirconium dichloride, rac-dimethylsilyl-bis-(1-indenyl)-zirconium dichloride, rac-dimethylgermyl-bis-(1-indenyl)-zirconium dichloride, rac-phenylmethylsilyl-bis-(1-indenyl)-zirconium dichloride, rac-phenylvinylsilyl-bis-(1-indenyl)-zirconium dichloride, 1-silacyclobutyl-bis-(1'-indenyl)-zirconium dichloride, rac-diphenylsilyl-bis-(1-indenyl)-halfnium dichloride, rac-phenylmethylsilyl-bis-(1-indenyl)-halfnium dichloride, rac-dimethylsilyl-bis-(1-indenyl)-halfnium dichloride, rac-diphenylsilyl-bis-(1-indenyl)-zirconium dichloride, diphenylmethylene-(9-flourenyl)-cyclopentandienyl-zirconium dichloride, and a mixture thereof. The metallocene catalyst can be used alone or in combination of two or more kinds.

The metallocene catalyst is preferably contained in an amount of $10^{-4}$ to $10^{-6}$ moles per 1 L of reactor volume, based on the amount of transition metal. If the content is less than $10^{-6}$ moles, productivity decreases, and if the content exceeds $10^{-4}$ moles, highly viscose polymer is prepared, which is difficult to transfer.

The cocatalyst is preferably a linear aluminoxane represented by the following Chemical Formula 10, or a cyclic aluminoxane represented by the following Chemical Formula 11.

[Chemical Formula 10]

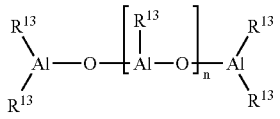

[Chemical Formula 11]

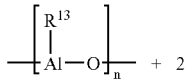

In the above Chemical Formulae 10 and 11, $R^{13}$ is independently a C1-C6 alkyl, a C1-C6 phenyl, or a C1-C6 benzyl, and n is an integer of 2 to 50.

The cocatalyst is preferably contained in an amount of 1 to $10^{-4}$ moles per 1 L of reactor volume, based on the amount of aluminum (Al). If the content exceeds 1 mole, post treatment cost increases due to an excessively introduced amount, and if the content is less than $10^{-4}$ moles, a catalyst cannot be activated.

After polymerization in the presence of the metallocene catalyst and the cocatalyst is completed, the copolymer of the cyclic olefin and the acyclic olefin is separated by introducing the polymerization product into a filter media together with water to precipitate, filter, and remove remaining catalyst and cocatalyst in the polymerization product, and then introducing the polymerization product into an anti-solvent to cause phase separation, and filtering it to obtain a solid phase polymer; or by recovering solvent and unreacted monomers with flash separation using a thin film evaporator to obtain a solid phase polymer.

Thus a polycyclic bi-copolymer, a polycyclic tert-copolymer, or a polycyclic multi-copolymer, etc. can be obtained.

After polymerization, although the monomer incorporation ratio may be varied according to polymerization factors such as reaction temperature, reaction pressure, catalyst concentration, cocatalyst concentration, etc., the incorporation ratio of cyclic olefin monomers is preferably 10 to 80 mole %.

And, the average molecular weight of the obtained copolymer may be varied according to degree of hydrogenation, change in catalyst concentration, temperature change, etc., and dispersity of the copolymer (Mw/Mn) is preferably 2.0 to 3.5. If the dispersity of the copolymer is less than 2.0, fixing is inferior, and if the dispersity exceeds 3.5, compatibility with the binder resin tends to decrease, and thus properties required in the present invention are insufficient.

As the binder resin, a common fixing resin can be used. A compound obtained by polymerization condensation of alcohol and carboxylic acid can be used.

As the alcohol, a divalent or multivalent alcohol such as ethylene glycol, diethylene glycol, triethylene glycol, polyethylene glycol, propylene glycol, butanediol, pentenediol, hexanediol, cyclohexanedimethanol, xylene glycol, bisphenol A, bisphenol A ethylene oxide, bisphenol A propylene oxide, sorbitol, glycerin, etc., or alcohol derivatives can be used.

As the carboxylic acid, divalent or multivalent carboxylic acid such as maleic acid, fumaric acid, phthalic acid, isophthalic acid, terephthalic acid, succinic acid, adipic acid, trimellitic acid, cyclopentene dicarboxylic acid, succinic acid anhydride, trimellitic acid anhydride, or maleic acid anhydride, etc., carboxylic acid derivatives, or carboxylic acid anhydride can be used.

The binder resin obtained by polymerization condensation of the alcohol and the carboxylic acid includes: an acrylic acid ester polymer such as polyester, polymethylacrylic acid, polyethylacrylic acid, polybutylacrylic acid, poly 2-ethylhexyl acrylic acid, or polylauryl acrylic acid, etc.; a methylacrylic acid ester polymer such as polymethylmethacrylic acid, polybutylmethacrylic acid, polyhexylmethacrylic acid, poly 2-ethylhexyl methacrylic acid, or polylauryl methacrylic acid, etc,.; a copolymer of an acrylic acid ester and a methacrylic acid ester; a copolymer of a styrene monomer and an acrylic acid ester or a methacrylic acid ester; an ethylene polymer such as polyvinylacetic acid, polyvinylpropionic acid, polyvinyllactic acid, polyethylene, or polypropylene, etc. or a copolymer thereof; a styrene copolymer such as a styrene-butadiene copolymer, a styrene-isoprene copolymer, or a styrene-maleic acid copolymer, etc.; polyvinylether; polyvinyl ketone; polyester; polyamide; polyurethane; a rubber-like substance; an epoxy resin; a polyvinylbutyrol rosin; a modified rosin; and a phenol resin, etc. Preferably, polyester is used.

As the colorant, a black colorant such as carbon black and a colored colorant such as a yellow colorant, a magenta colorant, or a cyan colorant can be used.

The yellow colorant includes a condensed nitrogen compound, an isoindolinone compound, an anthraquine compound, an azo metal complex, and an allyl amide compound, etc. For example, C.l.pigment yellow 12, C.l.pigment yellow 13, C.l.pigment yellow 14, C.l.pigment yellow 15, C.l.pigment yellow 17, C.l.pigment yellow 62, C.l.pigment yellow 74, C.l.pigment yellow 83, C.l.pigment yellow 93, C.l.pigment yellow 94, C.l.pigment yellow 95, C.l.pigment yellow 109, C.l.pigment yellow 110, C.l.pigment yellow 111, C.l.pigment yellow 128, C.l.pigment yellow 129, C.l.pigment yellow 147, or C.l.pigment yellow 168 can be used.

The magenta colorant includes condensed a nitrogen compound, anthraquine, a quinacridone compound, a base dye lake compound, a naphthol compound, a benzoimidazole compound, a thioindigo compound, and a pherylene compound, etc. For example, C.l.pigment red 2, C.l.pigment red 3, C.l.pigment red 5, C.l.pigment red 6, C.l.pigment red 7, C.l.pigment red 23, C.l.pigment red 48:2, C.l.pigment red 48:3, C.l.pigment red 48:4, C.l.pigment red 57:1, C.l.pigment red 81:1, C.l.pigment red 144, C.l.pigment red 146, C.l.pigment red 166, C.l.pigment red 169, C.l.pigment red 177, C.l.pigment red 184, C.l.pigment red 185, C.l.pigment red 202, C.l.pigment red 206, C.l.pigment red 220, C.l.pigment red 221, or C.l.pigment red 254 can be used.

The cyan colorant includes a copper phthalocyanine compound and derivative thereof, an anthraquine compound, and a base dye lake compound, etc. For example, C.I.pigment blue 1, C.I.pigment blue 7, C.I.pigment blue 15, C.I.pigment blue 15:1, C.I.pigment blue 15:2, C.I.pigment blue 15:3, C.I.pigment blue 15:4, C.I.pigment blue 60, C.I.pigment blue 62, or C.I.pigment blue 66 can be used.

The colorant is preferably contained in a sufficient amount to form a visual phase of sufficient concentration, and generally it is contained in an amount of 1 to 20 parts by weight, based on 100 parts by weight of the binding resin.

As the charge-control agent, a diallyl alkyl ammonium salt polymer or a nigrosine dye can be used.

The charge-control agent is preferably contained in an amount of 0.2 to 6 parts by weight, based on 100 parts by weight of the binding resin. If the content is less than 0.2 parts by weight, image density is not sufficient, and if the content exceeds 6 parts by weight, the effect increase is little, and production cost increases.

The toner particle is prepared by common pulverization through melt blending or polymerization, and the average particle diameter of the prepared toner particle is, although not limited, preferably 5 to 30 μm.

The present invention is characterized by externally adding hydrophobic silica having specific surface area of 100 to 240 $m^2/g$ and fine powder of an organic compound containing fluorine to the surface of the toner particle.

As the organic compound containing fluorine, polyfluorovinylidene or polytetrafluoroethylene can be used, and preferably polytetrafluorethylene is used.

The average particle diameter of the fine powder of the organic compound containing fluorine is preferably 0.1 to 4.0 μm, and more preferably 0.2 to 2.0 μm. If the diameter is less than 0.1 μm, the diameter of the fine powder is too small and the powder is completely embedded in the toner by operation of a high-speed mixer. Thus, the effects of decreasing friction between the charge-providing member and preventing contamination decrease and thus long term stability is not maintained. And, if the particle diameter exceeds 4.0 μm, the mixing property with the non-magnetic toner is insufficient and thus the particles are likely to disperse at the surface of the development roller, and the charge-providing member of the charging apparatus is contaminated to deteriorate image density.

The fine powder of the organic compound containing fluorine is preferably contained in an amount of 0.05 to 2.0 parts by weight, based on 100 parts by weight of toner particle, and more preferably in an amount of 0.1 to 1.5 parts by weight. If the content is less than 0.05 parts by weight, the toner particle surface is not sufficiently coated with the fine powder and thus the toner cannot be sufficiently positively charged, and toner durability and developer performance deteriorate due to sticking of the toner particle to the charge providing member. And, if the content exceeds 2.0 parts by weight, durability of the toner decreases because of sticking to the charge-providing member due to exfoliation of the added powder, and the fixing property deteriorates even if a copolymer of a cyclic olefin and an acyclic olefin is used together, due to complete coating of the toner particle with fine powder.

The hydrophobic silica having a specific surface area of 100 to 240 $m^2/g$ improves flowability and charging properties of the toner particle.

The specific surface area of the hydrophobic silica is preferably 100 to 240 $m^2/g$, and more preferably 130 to 200 $m^2/g$. If the specific surface area is less than 100 $m^2/g$, the flowability improvement effect is not sufficient and thus image contamination such as staining on a solid image may occur. And, if the specific surface area exceeds 240 $m^2/g$, silica is embedded onto the surface of the toner particle and thus the flowability improvement effect decreases, which decreases the effects of the fine powder.

The hydrophobic silica is preferably contained in an amount of 0.5 to 2.0 parts by weight, based on 100 parts by weight of the toner particle. If the content is less than 0.5 parts by weight, the flowability improvement effect is not sufficient, and if the content exceeds 2.0 parts by weight, the hydrophobic silica sticks to the surface of the toner particle, and the fixing property decreases.

The hydrophobic silica is prepared by making silica particles hydrophobic, preferably by coating or attaching an aminosilane-type coupling agent that contains positive charges on silica particles.

As the positive charge-containing aminosilane-type coupling agent, $H_2N(CH_2)_2NH(CH_2)_3Si(OCH_3)_3$, $H_2N(CH_2)_2NH(CH_2)_3Si(CH_3)(OCH_3)_2$, $H_2N(CH_2)_2NH(CH_2)_2Si(OCH_3)_3$, $H_2N(CH_2)_2NH(CH_2)_2NH(CH_2)_2Si(OCH_3)_3$, $H_2N(CH_2)_3Si(OCH_3)_3$, or $C_6H_5NH(CH_2)_3Si(OCH_3)_3$ can be used.

The fine powder of the organic compound containing fluorine and hydrophobic silica can be attached to the toner particle using a common agitator such as a turbine type agitator, a Hensel type mixer, a supermixer, etc., or by using a surface modifying machine (Nara hybridization system, Nara machine manufacture company). And, the hydrophobic silica may be weakly attached to the toner particle surface, or fixed on the surface with a part thereof embedded.

According to the non-magnetic mono-component toner of the present invention in which a fine powder of an organic compound containing fluorine is externally added to a toner particle comprising a copolymer of a cyclic olefin and an acyclic olefin, since the organic compound powder is selectively coated on the surface of the development roller and the powder makes the surface strongly positive, when a positive photosensitive member is used, the powder strongly pushes positive toner to the organic photosensitive member surface thereby achieving high transfer efficiency, and when transferred from a drum to a reporting medium of paper, toner transfer efficiency also increases by the same reason. Therefore, a stable image can be obtained due to high transfer efficiency, image density does not deteriorate, and background contamination of non-image areas is not caused. Also, off-set contamination of fixing area caused when using conventional an organic compound containing fluorine powder can be solved using the copolymer of a cyclic olefin and an acyclic olefin.

Accordingly, the non-magnetic mono-component toner of the present invention has superior transfer efficiency and charging properties, and thus can obtain a stable image, the image density does not deteriorate, and background contamination of non-image areas and off-set due to deterioration of fixing properties are not generated, even if copying or printing therewith is conducted for a long time use.

EXAMPLE

Example 1

(Preparation of a Copolymer of a Cyclic Olefin and an Acyclic Olefin)

A clean and completely dried 100 mL batch type reactor was prepared under an argon atmosphere, and then 800 mL of a norbornene solution (55 wt %) dissolved in toluene was introduced therein and temperature was elevated to 70° C. Into the reactor, isopropylene-(9-fluorenyl)-cyclopentadienyl-zirconium dichloride as a catalyst and MMAO-4 as a cocatalyst were introduced, and then polymerization was conducted for 20 minutes while maintaining ethylene pressure of 70 psi. The ethylene was then vented, 3 mL of ethanol was introduced to stop polymerization, and the polymer solution was removed from the reactor, and 5 L of acetone was added to obtain a solid phase copolymer. The obtained solid phase copolymer was filtered and then dried at 80° C. under reduced pressure for 18 hours to prepare a copolymer of a cyclic olefin and an acyclic olefin.

(Preparation of Toner Particle)

100 parts by weight of a polyester resin, 50 parts by weight of the prepared copolymer of a cyclic olefin and an acyclic olefin, 8 parts by weight of carbon black with an average particle diameter of 0.3 μm, 3 parts by weight of nigrosine dye, and 5 parts by weight of a release agent (polypropylene wax) were mixed using a Hensel mixer. The mixture was fusion blended in a twin screw extruder, mechanically pulverized, and distributed as 9.0 to 9.2 μm in a jet milling machine to prepare toner particle particles.

(Preparation of Non-Magnetic Mono-Component Toner)

To 100 parts by weight of the prepared toner particle, 0.05 parts by weight of polytetrafluorethylene fine powder and 1.0 parts by weight of hydrophobic silica RA200HS with a positive charge property (Japan Aerogel Company) were added, and they were agitated and mixed using a Hensel mixer for 4 minutes to coat on the toner particle surface to prepare a non-magnetic mono-component toner.

Example 2

A non-magnetic mono-component toner was prepared by the same method as in Example 1, except that 1.0 parts by weight of polytetrafluorethylene fine powder were used.

Example 3

A non-magnetic mono-component toner was prepared by the same method as in Example 1, except that 20 parts by weight of polytetrafluorethylene fine powder were used.

Comparative Example 1

A non-magnetic mono-component toner was prepared by the same method as in Example 1, except that polytetrafluorethylene fine powder was not used.

Comparative Example 2

(Preparation of Toner Particle)

150 parts by weight of a polyester resin, 8 parts by weight of carbon black with an average particle diameter of 0.3 μm, 3 parts by weight of nigrosine dye, and 5 parts by weight of a release agent (polypropylene wax) were mixed using a Hensel mixer. The mixture was fusion blended in a twin screw extruder, mechanically pulverized, and then distributed as 9.0 to 9.2 μm in a jet milling machine to prepare toner particle particles.

(Preparation of Non-Magnetic Mono-Component Toner)

To 100 parts by weight of the prepared toner particle, 1.0 parts by weight of polytetrafluorethylene fine powder and 1.0 parts by weight of hydrophobic silica RA200HS with a positive charge property (Japan Aerogel Company) were added, and they were mixed and agitated using a Hensel mixer for 4 minutes to coat on the toner particle surface to prepare a non-magnetic mono-component toner.

Comparative Example 3

A non-magnetic mono-component toner was prepared by the same method as in Example 1, except that 3.0 parts by weight of polytetrafluorethylene fine powder were used.

Comparative Example 4

A non-magnetic mono-component toner was prepared by the same method as in Example 1, except that 0.03 parts by weight of polytetrafluorethylene fine powder were used.

Experiment 1

8000 sheets at room temperature was printed with a commercially available non-magnetic mono-component development-type printer using the non-magnetic mono-component toner prepared in Examples 1 to 3 and Comparative Examples 1 to 4 as a contact development apparatus. And, image density, contamination of non-image areas, and fixing property were measured by the following methods, and the results are shown in Table 1.

a) image density (I.D.)—Image density of black solid area was measured with a densitometer (Mcbeth Company). If solid area image density is 1.35 or more, the toner can be used.

b) non-image area contamination—measured with a densitometer, and then compared with the value of reflection density of new paper. When there is non-image area contamination, it is indicated as O, and when there is no contamination, it is indicated as X.

c) fixing property—judged according to whether or not the same letters or patterns are repeated by off-set on an image printed at room temperature using a commercially available non-magnetic mono-component development-type printer using non-magnetic mono-component toner as contact development apparatus. In case repetition or image contamination due to off-set is not generated, it is judged as good, and in case it is generated, it is judged as no good (deterioration).

TABLE 1

| | | Example | | | Comparative Example | | | |
|---|---|---|---|---|---|---|---|---|
| | | 1 | 2 | 3 | 1 | 2 | 3 | 4 |
| Image density (500 sheets) | | 1.43 | 1.45 | 1.44 | 1.22 | 1.41 | 1.47 | 1.32 |
| Image density (8000 sheets) | | 1.41 | 1.42 | 1.41 | 1.14 | 1.39 | 1.23 | 1.30 |
| Non-image area contamination | Contamination | X | X | X | ○ | X | X | ○ |
| | Difference in reflection density | 0.12 | 0.08 | 0.05 | 1.05 | 0.32 | 0.27 | 0.64 |
| Fixing property | | good | good | good | good | no good | no good | good |

As shown in Table 1, the non-magnetic mono-component toners with positive charging properties for developing electrostatic charge images according to Examples 1 to 3 of the present invention do not involve problems in terms of image density, non-image part contamination, and fixing property, even if 8000 sheets is printed under common conditions. Specifically, the toner of the present invention has superior transfer efficiency and thus can obtain a stable image, does not show image density deterioration, has a superior fixing property, and does not generate background contamination of non-image areas, even if printing is conducted therewith for a long time use.

The non-magnetic mono-component toners with positive charging properties of Comparative Examples 1 to 4 began to show non-image area contamination after printing 1000 sheets, and after printing 4000 sheets the image density deteriorated or the fixing area was contaminated.

As explained, the non-magnetic mono-component toner of the present invention has superior transfer efficiency and charging properties, and thus can obtain stable images, does not show a deteriorated image density, and background contamination of non-image areas and off-set due to deterioration of fixing properties are not generated, even if copying or printing is conducted therewith for a long time use.

What is claimed is:

1. A non-magnetic mono-component toner composition which comprises:

a) 100 parts by weight of a non-magnetic toner particle comprising i) 100 parts by weight of a binding resin comprising 10 to 90 parts by weight of a copolymer of a cyclic olefin and an acyclic olefin polymerized in the presence of a metallocene catalyst and a cocatalyst, and 100 parts by weight of a binder resin, wherein the copolymer of a cyclic olefin and an acyclic olefin comprises at least 14 mol % of norbornene-type monomers, ii) 1 to 20 parts by weight of a colorant, and iii) 0.2 to 6 parts by weight of a charge-control agent;

b) 0.05 to 2.0 parts by weight of fine powder of an organic compound containing fluorine which is added to the surface of the non-magnetic toner particle, wherein the organic compound containing fluorine is polyfluorovinylidene or polytetrafluoroethylene and the fine powder of an organic compound containing fluorine has an average particle diameter of 0.1 to 4.0 μm; and c) 0.5 to 2.0 parts by weight of hydrophobic silica having a specific surface area of 100 to 240 $m^2/g$, wherein the hydrophobic silica is prepared by making silica particles hydrophobic with an aminosilane-type coupling agent that contains a positively charged group selected from the group consisting of $H_2N(CH_2)_2NH(CH_2)_3Si(OCH_3)_3$, $H_2N(CH_2)_2NH(CH_2)_3Si(CH_3)(OCH_3)_2$, $H_2N(CH_2)_2NH(CH_2)_2Si(OCH_3)_3$, $H_2N(CH_2)_2NH(CH_2)_2NH(CH_2)_2Si(OCH_3)_3$, $H_2N(CH_2)_3Si(OCH_3)_3$, $C_6H_5NH(CH_2)_3Si(OCH_3)_3$, and a mixture thereof.

2. The non-magnetic mono-component toner composition according to claim 1, wherein the a) i) copolymer of a cyclic olefin and an acyclic olefin comprises 0.01 to 99.9 wt % of cyclic olefin monomers and 0.01 to 99.9 wt % of acyclic olefin monomers.

3. The non-magnetic mono-component toner composition according to claim 2, wherein the cyclic olefin monomer is a norbornene-type monomer represented by one of the following Chemical Formulae 1 to 6, or an ethylene-based monomer represented by the following Chemical Formula 7:

[Chemical Formula 1]

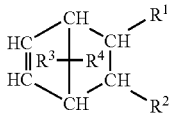

[Chemical Formula 2]

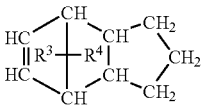

[Chemical Formula 3]

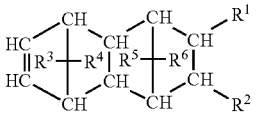

[Chemical Formula 4]

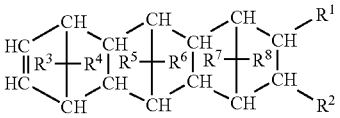

[Chemical Formula 5]

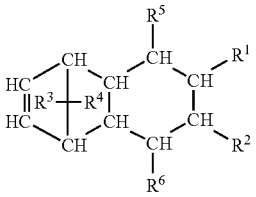

-continued

[Chemical Formula 6]

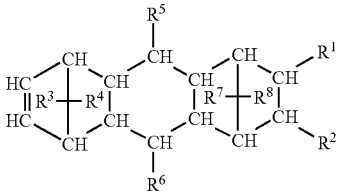

wherein in the above Chemical Formulae 1 to 6, $R^1$ to $R^8$ are independently hydrogen, C6-C16 aryls, or C6~C8 alkyls;

[Chemical Formula 7]

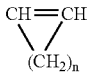

wherein in the above Chemical Formula 7, n is an integer of 2 to 10.

4. The non-magnetic mono-component toner composition according to claim 2, wherein the acyclic olefin monomer is represented by the following Chemical Formula 8:

[Chemical Formula 8]

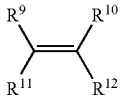

wherein in the above Chemical Formula 8, $R^9$ to $R^{12}$ are independently hydrogen or C1-C8 alkyls.

5. The non-magnetic mono-component toner composition according to claim 1, wherein the metallocene catalyst is represented by the following Chemical Formula 9:

[Chemical Formula 9]

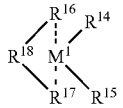

wherein in the above Chemical Formula 9, $M_1$ is titanium (Ti), zirconium (Zr), hafnium (Hf), vanadium (V), niobium (Nb) or tantalum (Ta);

$R^{14}$ and $R^{15}$ are independently hydrogen, halogens, C1-C10 alkyls, C1-C10 alkoxys, C6-C10 aryls, C6-C10 aryloxys, C2-C10 alkenyls, C7-C40 arylalkyls, C7-C40 alkylaryls, or C8-C40 arylalkenyls;

$R^{16}$ and $R^{17}$ are independently a mononuclear or polynuclear hydrocarbon radical that can form a sandwich structure together with the center atom $M^{1;}$ and $R^{18}$ is 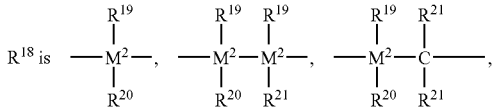

-continued

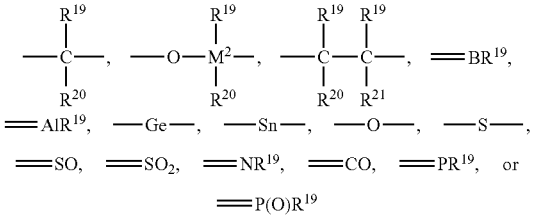

wherein $R^{19}$ to $R^{21}$ are independently hydrogen, halogens, C1-C10 fluoroalkyls, C1-C10 fluoroaryls, C6-C10 aryls, C1-C10 alkoxys, C6-C10 aryloxys, C2-C10 alkenyl, C7-C40 arylalkyls, or C8-C40 arylalkenyls, and $R^{19}$ to $R^{21}$ can be independently connected to neighboring carbons to form a ring; and $M^2$ is silicon (Si), germanium (Ge), or tin (Sn).

6. The non-magnetic mono-component toner composition according to claim 1, wherein the metallocene catalyst is selected from the group consisting of rac-ethylene-bis-(1-indenyl)-zirconium dichloride, isopropylene-(9-fluorenyl)-cyclopentadienyl-zirconium dichloride, rac-dimethylsilyl-bis-(1-indenyl)-zirconium dichloride, rac-dimethylgermyl-bis-(1-indenyl)-zirconium dichloride, rac-phenylmethylsilyl-bis-(1-indenyl)-zirconium dichloride, rac-phenylvinylsilyl-bis-(1-indenyl)-zirconium dichloride, 1-silacyclobutyl-bis-(1 '-indenyl)-zirconium dichloride, rac-diphenylsilyl-bis-(1-indenyl)-halfnium dichloride, rac-phenylmethylsilyl-bis-(1-indenyl)-halfnium dichloride, rac-dimethylsilyl-bis-(1-indenyl)-halfnium dichloride, rac-diphenylsilyl-bis-(1-indenyl)-zirconium dichloride, and diphenylmethylene-(9-flourenyl)-cyclopentandienyl-zirconium di chloride.

7. The non-magnetic mono-component toner composition according to claim 1, wherein the cocatalyst is a linear aluminoxane represented by the following Chemical Formula 10, or a cyclic aluminoxane represented by the following Chemical Formula 11:

[Chemical Formula 10]

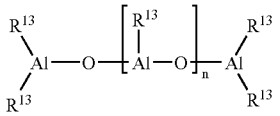

[Chemical Formula 11]

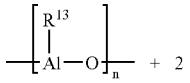

wherein in the above Chemical Formulae 10 and 11, $R^{13}$ is independently a C1-C6 alkyl, a C1-C6 phenyl, or a C1-C6 benzyl, and n is an integer of 2 to 50.

8. The non-magnetic mono-component toner composition according to claim 1, wherein the copolymer of a cyclic olefin and an acyclic olefin has dispersity of 2.0 to 3.5.

9. The non-magnetic mono-component toner composition according to claim 1, wherein the binder resin is prepared by condensation polymerization of alcohol and carboxylic acid.

10. The non-magnetic mono-component toner composition according to claim 9, wherein the alcohol is selected from the group consisting of ethylene glycol, diethylene glycol, triethylene glycol, polyethylene glycol, propylene glycol, butanediol, pentenediol, hexanediol, cyclohexanedimethanol, xylene glycol, bisphenol A, bisphenol A ethylene oxide, bisphenol A propylene oxide, sorbitol, glycerin, and derivatives thereof.

11. The non-magnetic mono-component toner composition according to claim 9, wherein the carboxylic acid is selected from the group consisting of maleic acid, fumaric acid, phthalic acid, isophthalic acid, terephthalic acid, succinic acid, adipic acid, trimellitic acid, cyclopentene dicarboxylic acid, succinic acid anhydride, trimellitic acid anhydride, maleic acid anhydride, carboxylic acid derivative, carboxylic acid anhydride, and a mixture thereof.

12. The non-magnetic mono-component toner composition according to claim 1, wherein the binder resin is selected from the group consisting of polyester, polymethylacrylic acid, polyethylacrylic acid, polybutylacrylic acid, poly 2-ethylhexyl acrylic acid, polylauryl acrylic acid, polymethylmethacrylic acid, polybutylmethacrylic acid, polyhexylmethacrylic acid, poly 2-ethylhexyl methacrylic acid, polylauryl methacrylic acid, a copolymer of an acrylic acid ester and a methacrylic acid ester, a copolymer of a styrene monomer and an acrylic acid ester or a methacrylic acid ester, polyvinylacetic acid, polyvinylpropionic acid, polyvinyllactic acid, polyethylene, polypropylene, a styrene-butadiene copolymer, a styrene-isoprene copolymer, a styrene-maleic acid copolymer, polyvinyl ether, polyvinyl ketone, polyester, a polyamide, polyurethane, rubber, an epoxy resin, a polyvinylbutyrol rosin, a modified rosin, a phenol resin, and a mixture thereof.

13. The non-magnetic mono-component toner composition according to claim 1, wherein the colorant is selected from the group consisting of carbon black, C.l. pigment yellow 12, C.l. pigment yellow 13, C.l. pigment yellow 14,C.l. pigment yellow 15, C.l. pigment yellow 17, C.l. pigment yellow 62, C.l. pigment yellow 74, C.l. pigment yellow 83, C.l. pigment yellow 93, C.l. pigment yellow 94, C.l. pigment yellow 95, C.l. pigment yellow 109, C.l. pigment yellow 110, C.l. pigment yellow 111, C.l. pigment yellow 128, C.l. pigment yellow 129, C.l. pigment yellow 147, C.l. pigment yellow 168, C.l. pigment red 2, C.l. pigment red 3, C.l. pigment red 5, C.l. pigment red 6, C.l. pigment red 7, C.l. pigment red 23, C.l. pigment red 48:2, C.l. pigment red 48:3, C.l. pigment red 48:4, C.l. pigment red 57:1, C.l. pigment red 81:1, C.l. pigment red 144, C.l. pigment red 146, C.l. pigment red 166, C.l. pigment red 169, C.l. pigment red 177, C.l. pigment red 184, C.l. pigment red 185, C.l. pigment red 202, C.l. pigment red 206, C.l. pigment red 220, C.l. pigment red 221, C.l. pigment. red 254, C.l. pigment blue 1, C.l. pigment blue 7, C.l. pigment blue 15, C.l. pigment blue 15:1, C.l. pigment blue 15:2, C.l. pigment blue 15:3, C.l. pigment blue 15:4, C.l. pigment blue 60, C.l. pigment blue 62, and C.l. pigment blue 66.

14. The non-magnetic mono-component toner composition according to claim 1, wherein the charge-control agent is a diallyl alkyl ammonium salt polymer or a nigrosine-type pigment.

15. The non-magnetic mono-component toner composition according to claim 1, wherein the a) toner particle has an average particle diameter of 5 to 30 μm.

* * * * *